US009149697B2

(12) United States Patent
Epling et al.

(10) Patent No.: US 9,149,697 B2
(45) Date of Patent: Oct. 6, 2015

(54) BALL BAT WITH OPTIMIZED BARREL WALL SPACING AND IMPROVED END CAP

(71) Applicant: Wilson Sporting Goods Co., Chicago, IL (US)

(72) Inventors: Sean S. Epling, Portland, OR (US); Ty B. Goodwin, Vancouver, WA (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 14/018,673

(22) Filed: Sep. 5, 2013

(65) Prior Publication Data

US 2014/0080642 A1 Mar. 20, 2014

Related U.S. Application Data

(60) Provisional application No. 61/701,312, filed on Sep. 14, 2012.

(51) Int. Cl.
*A63B 59/06* (2006.01)

(52) U.S. Cl.
CPC ..... *A63B 59/06* (2013.01); *A63B 2209/02* (2013.01)

(58) Field of Classification Search
CPC ..... A63B 59/06
USPC ..... 473/457, 519, 520, 564–568
See application file for complete search history.

(56) References Cited

U.S. PATENT DOCUMENTS

| | | | | | |
|---|---|---|---|---|---|
| 3,703,290 | A * | 11/1972 | Wilson | 473/520 |
| 3,861,682 | A | 1/1975 | Fujii | 273/72 |
| 3,963,239 | A | 6/1976 | Fujii | 273/72 |
| 3,972,528 | A | 8/1976 | McCracken et al. | 273/72 |
| 4,644,630 | A | 2/1987 | Blum | 29/453 |
| 4,951,948 | A | 8/1990 | Peng | 273/72 |
| 5,094,453 | A | 3/1992 | Douglas et al. | 273/72 |
| 5,364,095 | A | 11/1994 | Easton et al. | 273/72 |
| 5,395,108 | A | 3/1995 | Souders et al. | 273/72 |
| 5,415,398 | A | 5/1995 | Eggiman et al. | 273/72 |
| 5,421,572 | A | 6/1995 | MacKay, Jr. | 473/566 |
| 5,593,158 | A | 1/1997 | Filice et al. | 473/520 |
| 5,676,610 | A | 10/1997 | Bhatt et al. | 473/566 |
| 5,899,823 | A | 5/1999 | Eggiman | 473/566 |
| 5,931,750 | A | 8/1999 | MacKay, Jr. | 473/566 |
| 5,954,602 | A * | 9/1999 | Eggiman et al. | 473/566 |

(Continued)

FOREIGN PATENT DOCUMENTS

| | | | |
|---|---|---|---|
| JP | 50-7976 | 3/1975 | A63B 59/06 |
| JP | 51-13165 | 4/1976 | A63B 59/06 |

(Continued)

*Primary Examiner* — Mark Graham

(74) *Attorney, Agent, or Firm* — Terence P. O'Brien

(57) ABSTRACT

A ball bat extending along an axis configured for hitting a ball. The bat including a handle portion, a barrel portion coupled to the handle portion, a tubular sleeve positioned within the barrel portion, and an end cap. The barrel portion includes proximal and distal end regions, and a central region. The end cap is coupled to the sleeve and to the barrel portion by an adhesive. The end cap includes an end wall and an annular wall proximally extending from an inner surface of the end wall. The annular wall is configured to engage an inner surface of a distal end region of the sleeve. The annular wall defines at least one through-wall opening configured for facilitating flow of the adhesive through and about the annular wall during the coupling of the end cap to the barrel portion.

18 Claims, 9 Drawing Sheets

(56) References Cited

U.S. PATENT DOCUMENTS

| | | | | |
|---|---|---|---|---|
| 5,961,405 | A | 10/1999 | MacKay, Jr. | 473/566 |
| 5,964,673 | A | 10/1999 | MacKay, Jr. | 473/566 |
| 6,042,493 | A | 3/2000 | Chauvin et al. | 473/566 |
| 6,045,467 | A | 4/2000 | Anderson | 473/568 |
| 6,056,655 | A | 5/2000 | Feeney et al. | 473/567 |
| 6,099,422 | A | 8/2000 | Rappaport et al. | 473/567 |
| 6,176,795 | B1 | 1/2001 | Schullstrom | 473/566 |
| 6,248,032 | B1 | 6/2001 | Filice et al. | 473/566 |
| 6,251,034 | B1 | 6/2001 | Eggiman et al. | 473/567 |
| 6,287,221 | B1 | 9/2001 | Pino | 473/564 |
| 6,334,824 | B1 | 1/2002 | Filice et al. | 473/566 |
| 6,334,825 | B1 | 1/2002 | Buiatti | 473/566 |
| 6,383,101 | B2 | 5/2002 | Eggiman | 473/567 |
| 6,398,675 | B1 | 6/2002 | Eggiman et al. | 473/566 |
| 6,432,007 | B1 | 8/2002 | Filice et al. | 473/566 |
| 6,482,114 | B1 | 11/2002 | Eggiman et al. | 473/566 |
| 6,485,382 | B1 | 11/2002 | Chen | 473/566 |
| 6,497,631 | B1 | 12/2002 | Fritzke et al. | 473/566 |
| 6,663,517 | B2 | 12/2003 | Buiatti et al. | 473/566 |
| 6,702,698 | B2 | 3/2004 | Eggiman et al. | 473/566 |
| 6,733,404 | B2 | 5/2004 | Fritzke et al. | 473/566 |
| 6,743,127 | B2 | 6/2004 | Eggiman et al. | 473/567 |
| 6,764,419 | B1 | 7/2004 | Giannetti et al. | 473/567 |
| 6,793,127 | B2 | 9/2004 | Alsafadi et al. | 235/375 |
| 6,808,464 | B1 * | 10/2004 | Nguyen | 473/566 |
| 6,866,598 | B2 | 3/2005 | Giannetti et al. | 473/567 |
| 6,875,137 | B2 | 4/2005 | Forsythe et al. | 473/566 |
| 6,905,429 | B2 | 6/2005 | Forsythe et al. | 473/566 |
| 6,945,886 | B2 | 9/2005 | Eggiman et al. | 473/566 |
| 6,949,038 | B2 | 9/2005 | Fritzke | 473/566 |
| 6,991,551 | B2 | 1/2006 | Tolentino et al. | 473/167 |
| 6,997,826 | B2 | 2/2006 | Sutherland | 473/567 |
| 7,011,588 | B2 | 3/2006 | Fritzke et al. | 473/567 |
| 7,014,580 | B2 | 3/2006 | Forsythe et al. | 473/566 |
| 7,044,871 | B2 | 5/2006 | Sutherland et al. | 473/564 |
| 7,097,578 | B2 | 8/2006 | Guenther et al. | 473/567 |
| 7,115,054 | B2 | 10/2006 | Giannetti et al. | 473/567 |
| 7,128,670 | B2 | 10/2006 | Souders et al. | 473/567 |
| 7,140,988 | B1 | 11/2006 | Hinman | 473/566 |
| 7,163,475 | B2 | 1/2007 | Giannetti | 473/567 |
| 7,175,552 | B2 | 2/2007 | Fritzke et al. | 473/566 |
| 7,229,370 | B1 | 6/2007 | Vacek | 473/567 |
| 7,232,387 | B1 | 6/2007 | Heald et al. | 473/566 |
| 7,232,388 | B2 | 6/2007 | Sutherland et al. | 473/567 |
| 7,311,620 | B1 | 12/2007 | Heald et al. | 473/566 |
| 7,361,107 | B2 | 4/2008 | Giannetti et al. | 473/567 |
| 7,384,354 | B2 | 6/2008 | Giannetti | 473/567 |
| 7,410,633 | B2 | 8/2008 | Hellerstein | 424/9.1 |
| 7,419,446 | B2 | 9/2008 | Nguyen | 473/567 |
| 7,442,134 | B2 | 10/2008 | Giannetti et al. | 473/567 |
| 7,442,135 | B2 | 10/2008 | Giannetti et al. | 473/567 |
| 7,527,570 | B2 | 5/2009 | Giannetti et al. | 473/568 |
| 7,572,197 | B2 | 8/2009 | Chauvin et al. | 473/567 |
| 7,585,235 | B2 * | 9/2009 | Misono et al. | 473/567 |
| 7,601,083 | B1 | 10/2009 | Heald et al. | 473/566 |
| 7,604,184 | B1 | 10/2009 | Chen | 239/289 |
| 7,651,420 | B1 | 1/2010 | Gaff et al. | 473/567 |
| 7,749,115 | B1 | 7/2010 | Cruz et al. | 473/567 |
| 7,850,554 | B2 | 12/2010 | Burger | 473/567 |
| 7,857,719 | B2 | 12/2010 | Giannetti et al. | 473/567 |
| 7,867,114 | B2 * | 1/2011 | Sutherland et al. | 473/567 |
| 7,896,763 | B2 | 3/2011 | Giannetti et al. | 473/568 |
| 7,914,404 | B2 | 3/2011 | Giannetti et al. | 473/566 |
| 8,052,547 | B2 | 11/2011 | Nusbaum et al. | 473/457 |
| 8,062,154 | B2 | 11/2011 | Burger | 473/567 |
| 8,182,377 | B2 | 5/2012 | Chuang et al. | 473/567 |
| 8,197,365 | B2 | 6/2012 | Tokieda | 473/566 |
| 8,197,366 | B2 | 6/2012 | Chauvin et al. | 473/566 |
| 8,282,516 | B2 | 10/2012 | Chauvin et al. | 473/566 |
| 8,298,102 | B2 | 10/2012 | Chauvin et al. | 473/566 |
| 8,317,640 | B1 | 11/2012 | Cruz et al. | 473/567 |
| 8,376,881 | B2 | 2/2013 | Chuang et al. | 473/567 |
| 8,480,519 | B2 | 7/2013 | Chauvin et al. | 473/566 |
| 8,506,429 | B2 | 8/2013 | Chauvin et al. | 473/566 |
| 2002/0091022 | A1 * | 7/2002 | Fritzke et al. | 473/566 |
| 2003/0153416 | A1 * | 8/2003 | Anderson | 473/566 |
| 2009/0280934 | A1 * | 11/2009 | Watari et al. | 473/566 |
| 2013/0035181 | A1 | 2/2013 | Chauvin et al. | 473/566 |
| 2015/0005114 | A1 * | 1/2015 | Tsukamoto et al. | 473/566 |

FOREIGN PATENT DOCUMENTS

| | | | |
|---|---|---|---|
| JP | 63-38477 | 2/1988 | A63B 59/06 |
| JP | H2-243173 | 9/1990 | A63B 59/06 |

* cited by examiner

BALL BAT WITH OPTIMIZED BARREL WALL SPACING AND IMPROVED END CAP

RELATED U.S. APPLICATION DATA

The present invention claims the benefit of the filing date under 35 U.S.C. §119(e) of U.S. Provisional Patent Application Ser. No. 61/701,312, filed on Sep. 14, 2012, which is hereby incorporated by reference in its entirety. The present application is related to U.S. patent application Ser. No. 14/018,638 filed on the same day herewith by Sean S. Epling and Ty B. Goodwin entitled BALL BAT WITH OPTIMIZED BARREL WALL SPACING AND IMPROVED END CAP, the full disclosure of which is hereby incorporated by reference.

FIELD OF THE INVENTION

The present invention relates to a ball bat including a barrel portion having optimized barrel wall spacing and an improved end cap.

BACKGROUND OF THE INVENTION

Ball bats are well known and include a barrel portion connected to a handle portion with a knob connected to the handle or proximal end of the bat and an end cap connected to the barrel or distal end of the bat. Ball bats have traditionally been made of wood, but their construction has evolved over the years to aluminum alloys, other alloys, and/or fiber composite materials. With the use of new materials and bat configurations, ball bat performance has also improved to the point where many baseball and softball organizations publish and update equipment standards and/or requirements including performance limitations for ball bats. Some softball organizations, for example, have specified the use of soft balls that have lower compression values and can also have higher coefficient of restitution values. The newer soft ball specifications can reduce the performance level compared to soft balls formed of a higher compression value. Ball bat manufacturers produce ball bats designed to meet the applicable performance limitations of the applicable baseball and softball organizations. Further, as bat performance limitations continue to be restricted, ball bat manufacturers seek other ways of improving overall performance and playability of ball bats. One objective can be to enlarge the sweet spot of a bat. Accordingly, many bat manufacturers seek to configure a bat that provides more consistent performance over a greater area of the barrel, and provides an improved feel upon impact with a ball.

Many of the newer requirements and limitations affect the playability, performance and feel of ball bats. For example, when lower compression softballs are impacted by many existing high performance softball bats, the softer, lower compression balls do not generate the same force when impacting the ball bat and thus less vibrational energy is transferred from the location of impact to the user's hands. Although some may find this lack of feedback or feel desirable, most skilled softball players seek such feedback or feel upon hitting a softball. Higher level players want to correlate the feel of the impact to the travel of the batted ball and the location where the ball impacted the barrel. In this way, the player can adjust and/or correct his or her swing to improve their performance in future at-bats.

Further, ball bat performance limitations require the maximum performance level of ball bats to be reduced. In many existing bats, when the maximum performance level is reduced, the remaining areas of the bat area are also reduced, and in some cases significantly reduced. In other words, in an effort to reduce the highest performance location on a ball bat, typically referred to as the sweet spot. Some constructions not only reduce the performance of the bat at the "sweet spot" but also lower the performance level of other locations on the bat barrel thereby significantly reducing the overall performance level of the bat. Accordingly, many existing bats satisfy the maximum performance limitations, but offer very poor performance to the batter for impacts occurring away from the sweet spot of the ball bat.

Accordingly, a need exists for a ball bat that satisfies existing performance standards while providing a consistent high performance level over a larger hitting area of the barrel portion of the ball bat. What is also needed is a softball bat that provides exceptional performance even when used with a lower compression softball, and that provides feedback to the user upon impact of the bat to a pitched ball. It would be advantageous to provide a softball bat that provides the player with immediate feedback to enable the player to feel how well and/or where the player impacted the bat on the barrel portion of the bat. What is also needed is a ball bat that is configured to offer more advantages or benefits to users than just satisfying existing applicable ball bat equipment performance limitations and requirements.

SUMMARY OF THE INVENTION

The present invention provides a ball bat extending about a longitudinal axis and configured for hitting a baseball or softball. The bat includes a barrel portion coupled to a handle portion having a distal end region, a tubular sleeve positioned within the barrel portion and an end cap. The barrel portion is formed at least in part of a fiber composite material. The barrel portion includes a proximal end region, a distal end region, a central region between the proximal and distal end regions, and at least an inner wall and an outer wall. The inner and outer walls define a first separation and are configured to allow for independent movement between the inner wall and the outer wall upon impact with the ball. The tubular sleeve is positioned within the barrel portion, and includes a proximal end region and a distal end region. The proximal end region of the tubular sleeve is coupled to the distal end region of the handle portion. At least a portion of the tubular sleeve being separated from the inner layer to define a second separation. The second separation is within the nominal range of 0.030 to 0.125 inch when measured radially from the longitudinal axis. Upon impact with the ball, the barrel portion deflects inwardly at the impact location such that the inner wall operably engages the tubular sleeve. The end cap is coupled to the distal end region of the sleeve and to the distal end region of the barrel portion.

A ball bat extends along a longitudinal axis and is configured for hitting a ball. The bat includes a handle portion having a distal end region, a barrel portion coupled to the handle portion, a tubular sleeve positioned within the barrel portion, and an end cap. The barrel portion is formed at least in part of a fiber composite material. The barrel portion includes a proximal end region, a distal end region, a central region between the proximal and distal end regions, and at least an inner wall and an outer wall. The inner and outer walls define a first separation and are configured to allow for independent movement between the inner wall and the outer wall upon impact with the ball. The tubular includes a proximal end region and a distal end region. The proximal end region of the tubular sleeve is coupled to the distal end region of the handle portion. At least a portion of the tubular sleeve is separated from the inner layer to define a second separation. The ratio of the second separation to the first separation is at least 10. The end cap is coupled to the distal end region of the sleeve and to the distal end region of the barrel portion.

A ball bat extends along a longitudinal axis and is configured for hitting a ball. The bat includes a handle portion, a barrel portion coupled to the handle portion, a tubular sleeve positioned within the barrel portion, and an end cap. The barrel portion includes a proximal end region, a distal end region, and a central region between the proximal and distal end regions. The tubular sleeve is positioned within the barrel portion, and includes a proximal end region and a distal end region. The proximal end region of the tubular sleeve is coupled to the handle portion. The end cap is coupled to the distal end region of the sleeve and to the distal end region of the barrel portion at least in part by an adhesive. The end cap includes an end wall having an inner surface and an outer surface, and an annular wall proximally extending from the inner surface of the end wall toward the handle portion. The annular wall of the end cap is configured to engage an inner surface of the distal end region of the sleeve. The annular wall defines at least one through-wall opening configured for facilitating flow of the adhesive through and about the annular wall during the coupling of the end cap to the barrel portion.

A method of applying an improved end cap to a multi-wall ball bat having a longitudinal axis. The method including the steps of obtaining the end cap that includes an end wall having an inner surface, an outer surface and forming an outer lip, and an annular wall proximally extending from the inner surface of the end cap toward the handle portion. The annular wall defines at least one through-wall opening. The method further including obtaining a longitudinally extending tubular sleeve having a distal end region, sliding the distal end region of the tubular sleeve over at least a portion of the annular wall, and positioning the barrel portion over the tubular sleeve and over at least a portion of the annular wall until the distal end region of the barrel portion engages the outer lip of the end wall of the end cap. The method further including applying an initially flowable and curable adhesive into the end cap through the inner diameter of the tubular sleeve. The adhesive fills the inner surfaces of the distal end region of the sleeve, and flows through the at least one opening in the annular wall to extend between the distal end region of the sleeve and the distal end region of the barrel portion. The method also includes the step of allowing the adhesive to cure.

This invention will become more fully understood from the following detailed description, taken in conjunction with the accompanying drawings described herein below, and wherein like reference numerals refer to like parts.

DETAILED DESCRIPTION OF THE INVENTION

Figure 1:
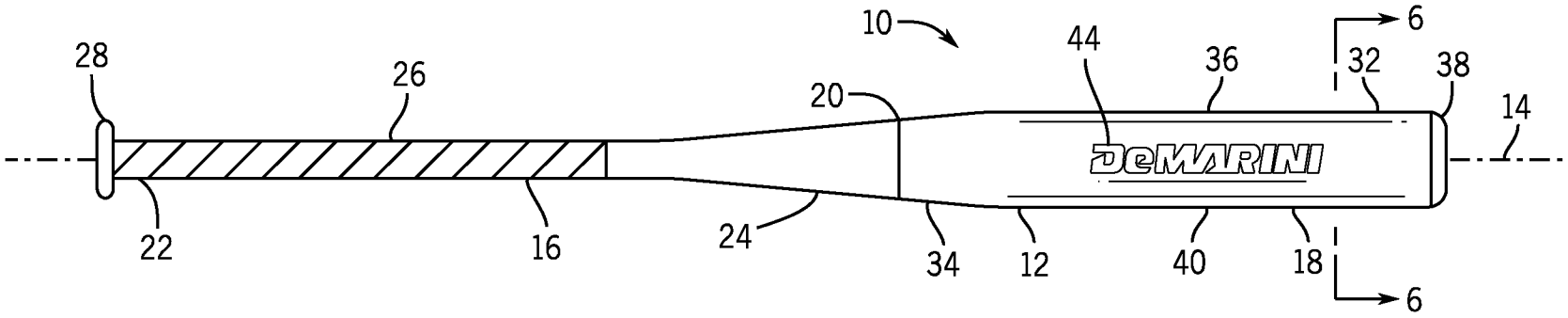
FIG. 1 is a side view of a ball bat in accordance with a preferred embodiment of the present invention.

Referring to FIG. 1, a ball bat is generally indicated at 10. The ball bat 10 of FIG. 1 is configured as a baseball bat; however, the invention can also be formed as a softball bat, a rubber ball bat, or other form of ball bat. The bat 10 includes a frame 12 extending along a longitudinal axis 14. The tubular frame 12 can be sized to meet the needs of a specific player, a specific application, or any other related need. The frame 12 can be sized in a variety of different weights, lengths and diameters to meet such needs. For example, the weight of the frame 12 can be formed within the range of 15 ounces to 36 ounces, the length of the frame can be formed within the range of 24 to 36 inches, and the maximum diameter of the barrel portion 18 can range from 1.5 to 3.5 inches.

The frame 12 has a relatively small diameter handle portion 16, a relatively larger diameter barrel portion 18 (also referred as a hitting or impact portion), and an intermediate tapered region 20. The intermediate tapered region 20 can be formed by the handle portion 16, the barrel portion 18 or a combination thereof. In one preferred embodiment, the handle and barrel portions 16 and 18 of the frame 12 can be formed as separate structures, which are connected or coupled together. This multi-piece frame construction enables the handle portion 16 to be formed of one material, and the barrel portion 18 to be formed of a second, different material (or two or more different materials).

The handle portion 16 is an elongate structure having a proximal end region 22 and a distal end region 24, which extends along, and diverges outwardly from, the axis 14 to form a substantially frusto-conical shape for connecting or coupling to the barrel portion 18. Preferably, the handle portion 16 is sized for gripping by the user and includes a grip 26, which is wrapped around and extends longitudinally along the handle portion 16, and a knob 28 connected to the proximal end 22 of the handle portion 16. The handle portion 16 is formed of a strong, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof.

Figure 2:
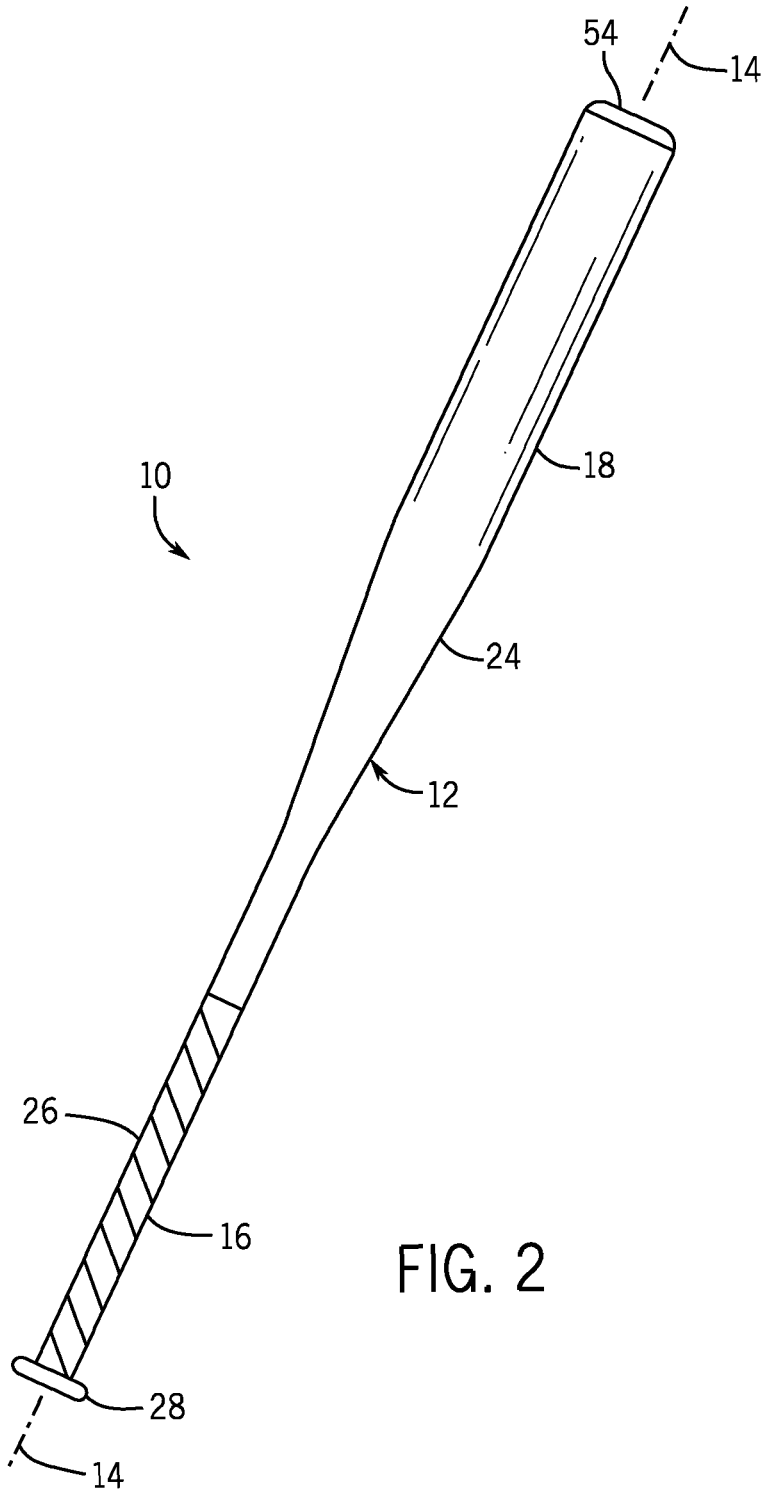
FIG. 2 is a side view of a ball bat in accordance with an alternative preferred embodiment of the present invention.

Referring to FIG. 2, in an alternative preferred embodiment, the bat frame 12 of the bat 10 can be formed as a one piece, integral structure. The bat frame 12 includes the handle and barrel portions 16 and 18, but they are formed as single, one-piece body. In other words, the bat frame 12 is not produced as a separate handle and barrel portions that are bonded, molded or otherwise attached together, and the handle and barrel portions cannot be separated without damaging one or both of the handle and barrel portions. The use of fiber composite material in the embodiments discussed below for the barrel portion 18 are equally applicable to the one piece bat frame 12.

Figure 3A:
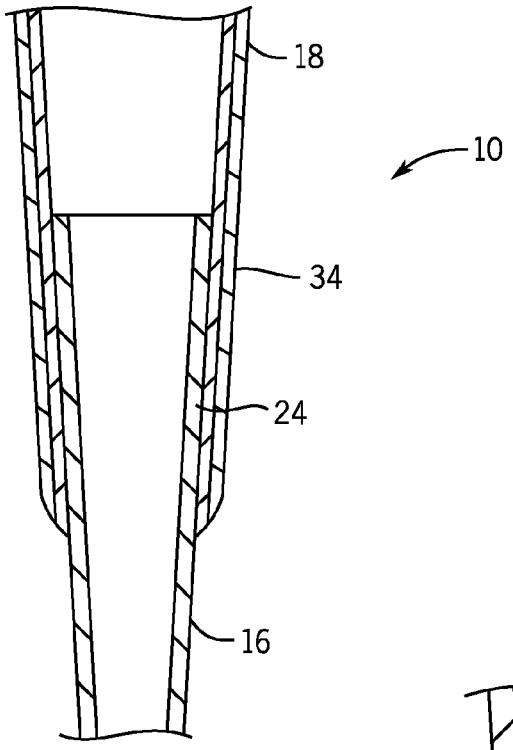
FIG. 3*a* is a longitudinal cross-sectional view of the coupling of a handle portion and a barrel portion of the bat of FIG. 1 without a sleeve.
Figure 4:
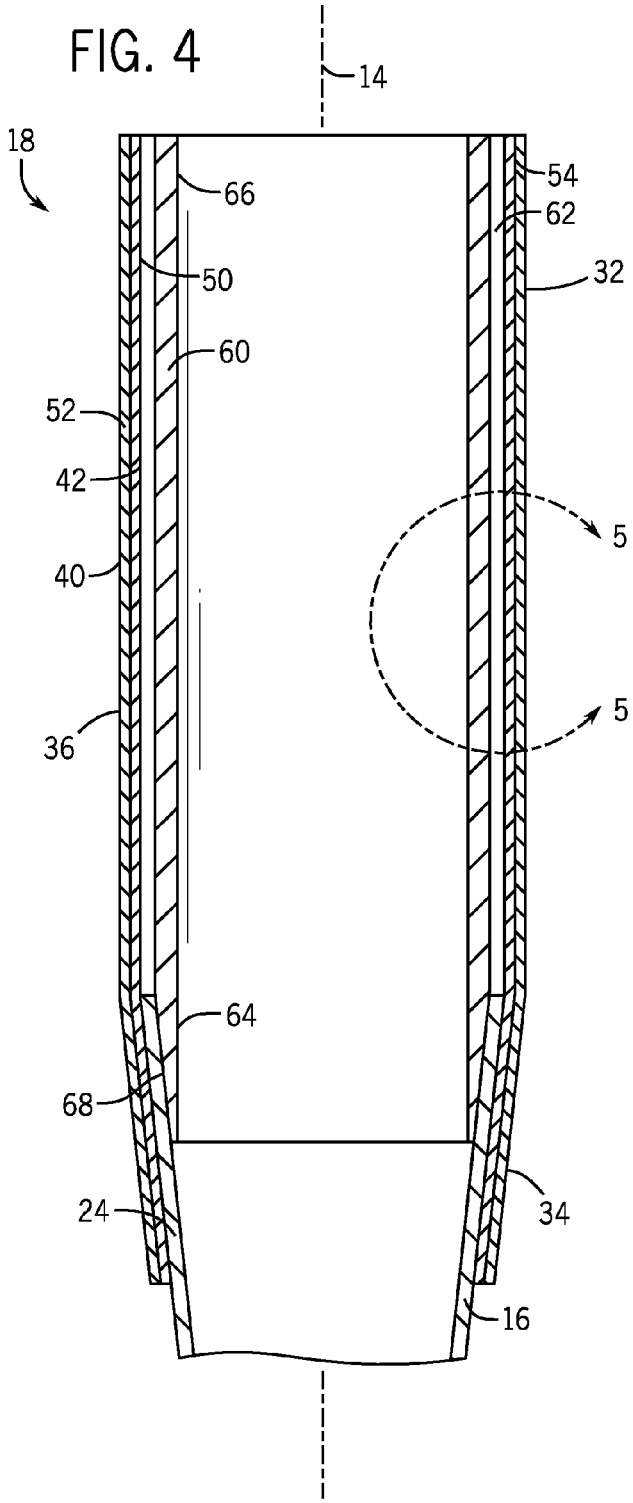
FIG. 4 is a longitudinal cross-sectional view of the barrel portion of the ball bat of FIG. 1.

Referring to FIGS. 1, 3*a* and 4, the barrel portion 18 of the frame 12 is "tubular," "generally tubular," or "substantially tubular," each of these terms is intended to encompass softball style bats having a substantially cylindrical impact (or "barrel") portion as well as baseball style bats having barrel portions with generally frusto-conical characteristics in some locations. The barrel portion 18 extends along the axis 14 and has a distal end region 32, a proximal end region 34, and a central region 36 disposed between the distal and proximal end regions 32 and 34. The proximal end region 34 converges toward the axis 14 in a direction toward the proximal end of the barrel portion 18 to form a frusto-conical shape that is complementary to the shape of the distal end region 24 of the handle portion 16. In this manner, the complementary shapes form a mechanical lock or attachment mechanism that inhibits separation of the barrel portion 18 from the handle portion 16. The barrel portion 18 can be directly connected to the handle portion 16. The connection can involve a portion, or substantially all, of the distal end region 24 or tapered region 20 of the handle portion 16 and the proximal end region 34 of the barrel portion 18. An adhesive can be used to connect the handle portion 16 and the barrel portion 18. Alternatively, one of the barrel portion 18 and the handle portion 16 can be over-molded to the other. The bat 10 further includes an end cap 38 attached to the distal end 32 of the barrel portion 18 to substantially enclose the distal end 32.

Figure 3B:
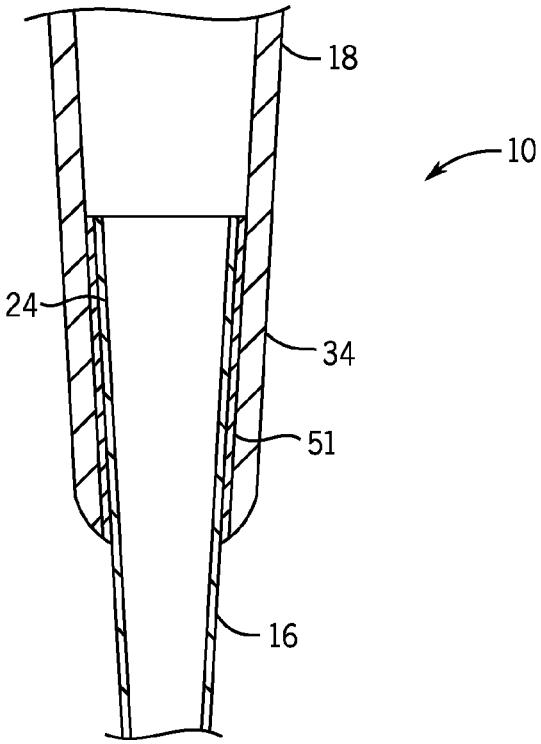
FIG. 3*b* is longitudinal cross-sectional view of the coupling of the handle portion of the bat to the barrel portion of the bat in accordance with an alternative preferred embodiment of the present invention.

Referring to FIG. 3*b*, in an alternative preferred embodiment an intermediate member 51 can be used to space apart, couple and/or attach the handle portion 16 to the proximal member 34 of the barrel portion 18. The intermediate member 51 can space apart all or a portion of the barrel portion 18 from the handle portion 16, and it can be formed of an elastomeric material, an epoxy, an adhesive, a plastic, a metal and combinations thereof. In one particularly preferred embodiment, the distal end region 24 of the handle portion 16 can be formed with a plurality of ribs or projections that provide points or areas of contact between the handle and barrel portions 16 and 18, and the intermediate member 51 can be positioned between or among the points or areas of contact.

Figure 5:
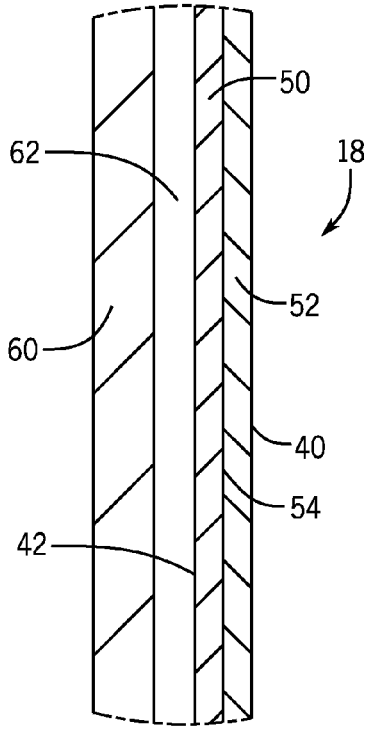
FIG. 5 is an enlarged view of a section of the walls of the barrel portion of the ball bat taken at circle 5 of FIG. 4.

Referring to FIGS. 1, 4 and 5, the barrel portion 18 includes an outer surface 40 and an inner surface 42. The handle and barrel portions 16 and 18 can be coated and/or painted with one or more layers of paint, clear coat, inks, coatings, primers, and other conventional outer surface coatings. The outer surface 40 of the barrel portion 18 and/or the handle portion 16 can also include alpha numeric and/or graphical indicia 44 indicative of designs, trademarks, graphics, specifications, certifications, instructions, warnings and/or markings. The indicia 44 can be a trademark that is applied as a decal, as a screening or through other conventional means.

The barrel portion 18 is preferably formed of strong, durable and resilient material, such as, a fiber composite material. As used herein, the terms "composite material" or "fiber composite material" refer to a matrix or a series of plies (also referred to as sheets or layers) of fiber bundles impregnated (or permeated throughout) with a resin. Each of the fiber bundles includes a plurality of fibers. The fibers are formed of a high tensile strength material such as carbon. Alternatively, the fibers can be formed of other materials such as, for example, glass, graphite, boron, basalt, carrot, Kevlar®, Spectra®, poly-para-phenylene-2,6-benzobisoxazole (PBO), hemp and combinations thereof. The resin is preferably a thermosetting resin such as epoxy or polyester resins. Alternatively, different resin formulations can be used. During heating and curing, the resin can flow between plies and within the fiber bundles. In alternative embodiments, one or more of the plies, sheet or layers of the composite material can be a braided or weaved sheet. In other alternative preferred embodiments, the one or more plies or the entire fiber composite material can be a mixture of chopped and randomly fibers dispersed in a resin. In alternative preferred embodiments, the barrel portion 18 can be formed of one or more composite or fiber composite materials, an aluminum alloy, a titanium alloy, a scandium alloy, steel, other alloys, a thermoplastic material, a thermoset material, wood or combinations thereof. In other preferred embodiments, the fiber composite material can be formed form a resin transfer molding operation or a vacuum assisted resin transfer molding operation.

In one implementation, at least a region of the barrel portion 18 is formed as a double wall construction, wherein the barrel portion includes at least an inner wall 50 and an outer wall 52. The inner and outer walls 50 and 52 can be formed of one or more layers or plies of fiber composite material. The inner and outer walls 50 and 52 are adjacent each other but sufficiently separated to allow for independent movement of the inner and outer walls 50 and 52 upon impact with a ball. The inner and outer walls 50 and 52 are adjacent to each other in that they can be in direct contact with each other, or within 0.002 in of each other. The outer wall 52 of the barrel portion 18 forms the outer surface of the barrel portion 18, and the bat 10. The outer wall 52 is configured for contacting a ball during use. In one implementation, one or more thin scrim layers can by positioned within or between the two adjacent layers. A scrim layer can have a thickness of 0.001 to 0.004 in. In other implementations, a mold release can be used between the inner and outer walls 50 and 52 to allow for independent movement between the inner and outer walls 50 and 52 upon impact with a ball.

The separation or interface between the inner and outer walls 50 and 52 can be referred to as a first separation 54. The first separation 54 can vary depending on the size and type of bat, but is preferably very small or generally not visible to the naked eye (i.e., close to zero clearance). The spatial relationship (the first separation 54) between the inner and outer walls 50 and 52 only needs to be sufficient to allow the inner and outer walls 50 and 52 to move substantially independent of one another upon impact with a ball. This independent movement allows the insert to act much like a leaf spring upon impact. The presence of the scrim layer, the mold release, and/or a layer of grease or other lubricant in the first separation 54, facilitates such independent movement. The first separation 54 preferably has a nominal dimension (when measured radially from the longitudinal axis 14 to the outer surface 40 of the barrel portion 18) that is generally within the range of 0.0005 to 0.005 inch, and portions of the overlapped surfaces may have no separation. In other implementations, the barrel portion 18 can be formed of a triple or quadruple wall construction with a separation, equivalent to the first separation 54, between each of the three or four barrel portion walls.

Independent movement refers to the independent relative movement between adjacent areas of one wall to another. For example, when a single wall is impacted by a ball and deflects inwardly in response to the impact. The outer surface of the wall becomes compressively loaded due to the bending of the wall, and the inner surface of the wall becomes under tension (or tensile stress). Further, the mid-plane of the wall is not significantly loaded by compressive or tensile stress. When a double wall configuration is used, the each of the inner and outer walls undergoes the same loading characteristics as described above for the single wall configuration. Therefore, the inner surface of the outer wall will be under tension, while the outer surface of the inner wall will be under compressive load. The result can be relative independent movement of the two surfaces with respect to each other. A single wall configuration does not have such independent movement, nor does a double wall configuration where the two walls are glued or otherwise rigidly adhered to each other. A glued double wall configuration behaves much like a single wall configuration. A double or multi-wall configuration that includes a separation can exhibit independent movement similar to that of a leaf spring. Independent movement increases the flexibility and responsiveness of the double or multi-wall configuration compared to a single wall configuration or a double wall configuration where the walls are fixedly or rigidly adhered to each other.

The inner and outer walls 50 and 52 are configured to act as two essentially parallel walls in the "hitting zone" or barrel portion 18. The independent movement provided by the first separation 54 makes the inner and outer walls 50 and 52 more easily deflected upon impact with a ball compared to a single wall material of the same thickness as the inner and outer walls without the first separation. The inner and outer walls 50 and 52 are designed to have independent movement through the first separation 54, a scrim layer, a mold release or other means.

Figure 6:
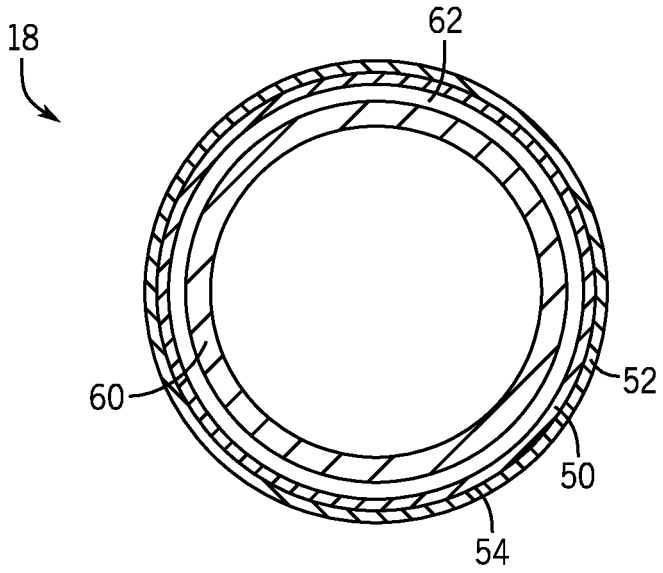
FIG. 6 is a transverse cross-sectional view of the barrel portion taken along line 6-6 of FIG. 1.

Referring to FIGS. 4-6, in one implementation, a tubular sleeve 60 can be positioned within the barrel portion 18. In one implementation, the sleeve 60 can have a consistent inner and/or outer diameter along its length. In another implementation, the sleeve can have a consistent inner and/or outer diameter along its length in a region that corresponds to the central portion 36 of the barrel portion 18. In other implementations, the sleeve can be formed with some amount of taper or curvature along its length such that the wall thickness of the sleeve 60 can be uniform or vary along its length. The sleeve 60 is cylindrical or substantially cylindrical. The sleeve 60 can be formed of one or more of the materials similar to that of the barrel portion 18, as described above. The tubular sleeve 60 includes a proximal end region 64 and a distal end region 66. The proximal end region 64 of the tubular sleeve 60 engages the distal end region 24 of the handle portion 16 and the distal end region 66 of the tubular sleeve 60 engages the end cap 38. Over at least a portion of the length of the tubular sleeve 60, the sleeve 60 is preferably visibly spaced apart from the inner wall 50 of the barrel portion 18 (or the inner most wall of a triple or quadruple wall barrel portion) by an amount referred to as a second separation 62. Accordingly, the space between the barrel portion 18 and the sleeve 60 define the second separation 62. The second separation 62 is preferably sized to be within the range of 0.030 to 0.125 inch (when measured radially from the longitudinal axis 14 to the outer surface 40 of the barrel portion 18). Other dimensions for the second separation 62 can also be used provided that the barrel portion 18 is able to operably engage the tubular sleeve 60 upon impact with a pitched ball. The second separation 62 is preferably at least an order of magnitude greater in size, such that in one preferred embodiment the ratio of the second separation 62 to the first separation 54 is at least 10. In other preferred embodiments, the ratio of the second separation 62 to the first separation 42 is at least 25. The second separation 62 is significantly greater than the first separation 54, but is preferably limited in size such that, upon impact with a pitched ball, the barrel portion 18 at the location of impact can deflect inwardly and operably engage and/or contact the outer surface of the tubular sleeve 60.

In one implementation, the second separation 62 extends along at least the length of the central region 36 of the barrel portion 18 measured with respect to the longitudinal axis 14. In another implementation, the second separation extends over at least 80 percent of the length of the barrel portion 18. In another implementation, the second separation 62 can be two or more separations spaced apart by one or more regions of contact between the inner wall 50 and the sleeve 60. In another implementation, one or more generally annular inserts can be positioned within the second separation to define two or more spaced apart separations between the inner layer and the sleeve.

Figure 7:
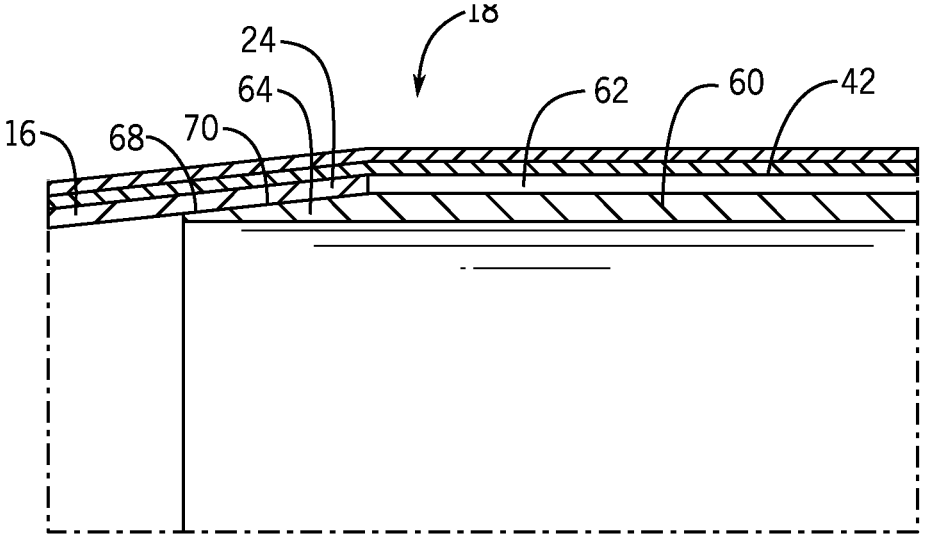
FIG. 7 is a longitudinal cross-sectional view of handle and barrel portions of a ball bat in accordance with another preferred embodiment of the present invention.

Referring to FIG. 7, in accordance with another preferred embodiment of the present invention, the barrel portion 18 can be formed of a single wall construction without the first separation 54. Although FIG. 7 illustrates a barrel portion 18 having a single wall, much of the discussion below is applicable to a barrel portion formed of a double, triple or quadruple wall construction, such as the double wall barrel portion 18 of FIGS. 4-6. The tubular sleeve 60 is positioned within the barrel portion 18 to define the second separation 62 over at least a portion of the length of the tubular sleeve 60, and preferably fully extends to the distal end region 24 of the handle portion 16. By extending the second separation 62 to the distal end region 24, the performance advantages of the second separation 62, as discussed below, can be realized even on ball impacts occurring near the distal end region 24. The proximal end region 64 of the sleeve 60 is preferably press fit to the inner surface 68 of the distal end region 24 of the handle portion 16. The press-fit engagement allows for a desirable, efficient connection between the proximal region 64 of the sleeve 60 and the distal end region 24. The press-fit connection also provides for transfer of vibrational and/or shock energy resulting from contact between the inner wall 52 with the sleeve 60 during impact with a ball. The direct press-fit connection provides direct feedback to the batter. The combination of the telescopic engagement (mechanical locking arrangement) of the proximal end region 34 of the barrel portion 18 to the distal end region 24 of the handle portion, and the press-fit engagement of the sleeve 60 to the distal end region 24 allows for optimized vibrational feedback provided to the batter, even on mis-hit or lightly hit balls. In one particularly preferred embodiment, the proximal end region 64 can include a chamfer 70 to facilitate the press-fit engagement of the proximal end region 64 of the sleeve 60 to the distal end region 24 of the handle portion 16. In other preferred embodiments, the sleeve 60 can be formed without a chamfer and have a generally uniform thickness along the proximal end region 64. In still other preferred embodiments, other fastening mechanisms can be used such as an epoxy adhesive, a urethane adhesive, other forms of adhesives, thermal bonding, and intermediate fastening elements.

In an alternative preferred embodiment, one or more layers of material can be positioned between the proximal end 64 of the sleeve 66 and the distal end region 24 of the handle portion 16 to isolate the sleeve from the handle portion 16. The layer of material can be an elastomeric material or any material that dampens vibration and shock, like intermediate member 51.

The at least one layer of material (similar to intermediate member 51) can space apart all or a portion of the sleeve 60 from the handle portion 16, and it can be formed of an elastomeric material, an epoxy, an adhesive, a plastic, a metal and combinations thereof. Such a configuration may be desirable for certain players, applications, ball configurations etc.

Figure 8:
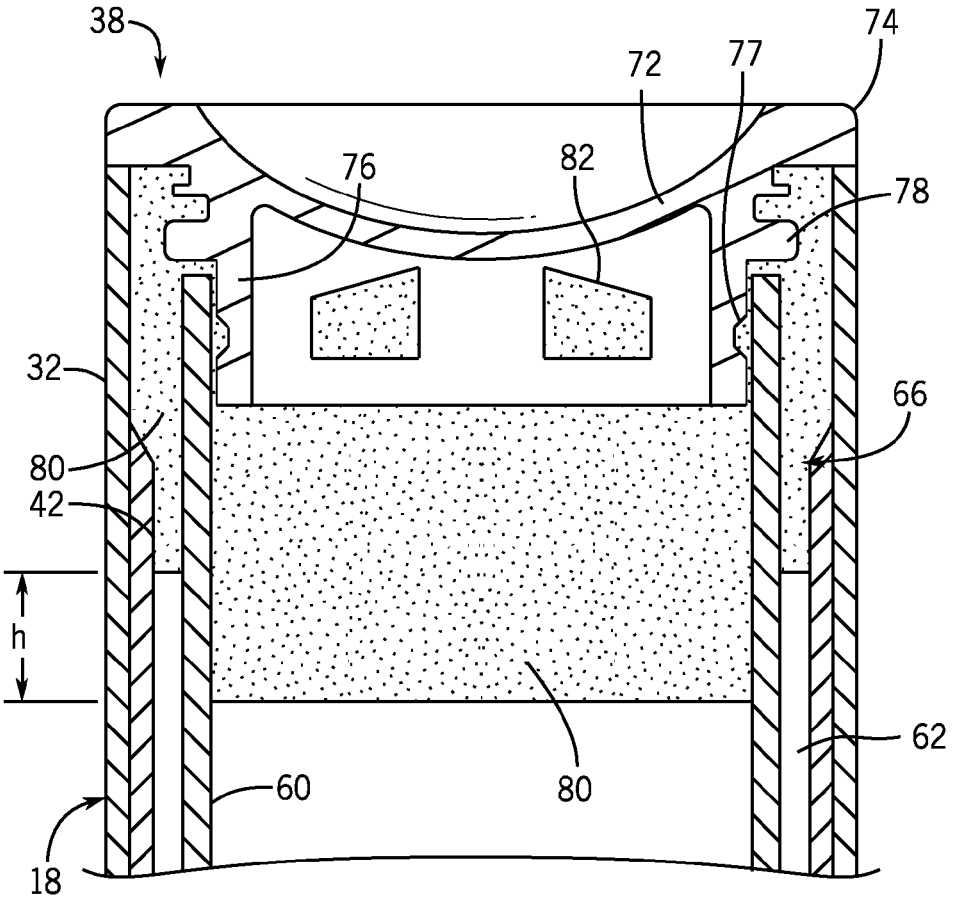
FIG. 8 is a longitudinal cross-sectional view of the barrel portion of FIG. 1 and an end cap of the ball bat.
Figure 9:
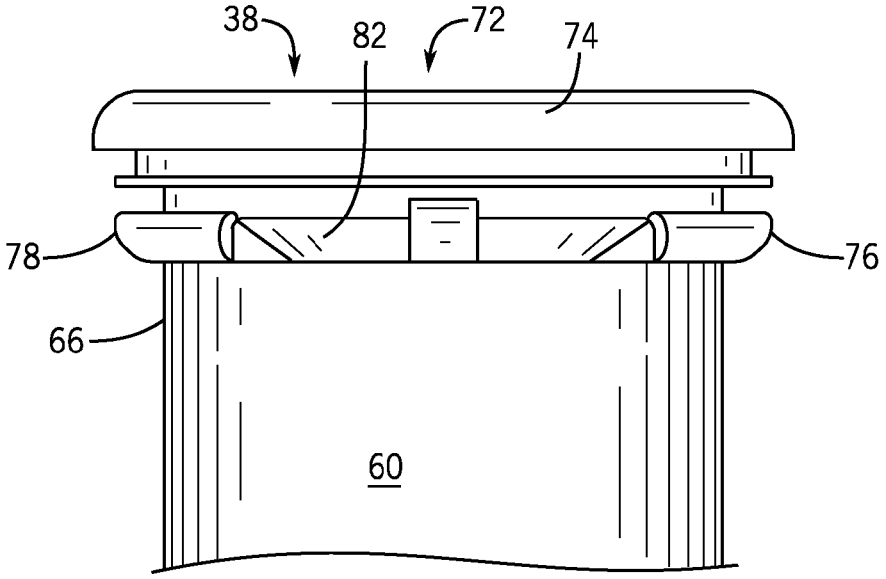
FIG. 9 is a side perspective view of the distal end of a sleeve and the end cap of FIG. 8.

Referring to FIGS. 8 and 9, the engagement of the distal end region 66 of the sleeve 60 to the end cap 38 is shown. Although FIG. 8 illustrates the barrel portion 18 having a single wall, much of the discussion below is applicable to a barrel portion formed of a double, triple or quadruple wall construction. The end cap 38 enables the second separation 62 to extend to at or near the end cap 38. Accordingly, the performance advantages provided by the second separation, as discussed below, can be provided at or near the distal end region 32 of the barrel portion 18. The end cap 38 includes an end wall 72 having an outer lip 74, and an annular wall 76 proximally extending from an inner surface of the end wall 72. The annular wall 76 can include an outwardly extending ridge 78. The end cap 38 is advantageously configured to provide for the spacing of distal end region 66 of the sleeve 60 with the distal end region 32 of the barrel portion 18, and to allow for the extension of the second separation 62 toward the end cap 38. The outer lip 74 of the end wall 72 also provides a stop, end or covering to the distal end of the barrel portion 18. The annular wall 76 is configured to extend within the sleeve 60, and to facilitate the orientation and/or spacing apart of the distal end region 34 of the barrel portion 18 from the distal end region 66 of the sleeve 60. The ridge 78 of the annular wall 76 can provide a stop or end for engaging the distal end of the sleeve 60. The distal ends of the barrel portion 18 and the sleeve 60 can extend all the way to the outer lip 74 and the ridge 78 or be positioned so as to be slightly spaced apart from the outer lip 74 and the ridge 78, respectively. The end cap 38 is preferably formed of a tough durable material, such as thermoplastic urethane. In alternative embodiments, the end cap can be formed of other materials, such as wood, a ceramic, a fiber composite material, a thermoset material, and/or other plastics.

The end cap 38 is preferably connected to the distal end regions 34 and 66 by use of an adhesive 80. The adhesive 80 is configured preferably quick setting, and configured to initially flow and cure to a set (non-viscous) condition. One example of a suitable epoxy adhesive is PT 1000 urethane adhesive from Willamette Valley Co., of Eugene, Oreg. Alternatively, other suitable adhesives can include other epoxy adhesives, urethane adhesives, or other adhesives.

Referring to FIGS. 8 through 14, the annular wall 76 defines one or more openings 82 for allowing the adhesive 80 to initially flow from within the sleeve 60 through the openings 82 and other spaces between the sleeve 60 and the end cap 38 (such as the spacing between the distal end of the sleeve 60 and the ridge 78). In one implementation, the end cap 38 can also include one or more grooves 77 for further facilitating the initial flow of the adhesive 80 about the end cap 38.

Referring to FIGS. 8 and 9, the distal end 32 of the barrel portion 18 can be machined to provide further space for flow of the adhesive and to facilitate proper positioning and centering of the end cap 38. The end cap 38 is shaped to assist in centering and spacing apart the distal end region of the sleeve 60 from the distal end region of the barrel portion 18 to assist in defining the second separation 62. Therefore, thickness of the distal end 32 of the barrel portion 18 can be reduced. The openings 82 and overall configuration of the end cap 38 provide a significant operational and production advantage by enabling the adhesive 80 to be applied in one simple efficient step within the sleeve 60.

The end cap 38 can be placed onto a horizontal surface with the annular wall 76 extending upward. The sleeve 60 can be slid over at least a portion of the annular wall 76. In one implementation, the distal end region 66 of the sleeve 60 extends over the annular wall 76 until it engages the ridge 78. The barrel portion 18 can be positioned over the sleeve 60 and over the annular wall 60 until the distal end region 34 of the barrel portion 18 engages the end cap 38. The barrel portion 18 and/or the bat 10 is positioned in a vertical position with the end cap 38 located at the bottom of the bat 10. The adhesive 80 can be applied within the sleeve 60 at the distal end 66, and initially flows and fills the open areas between the end cap 38, distal end 66 of the sleeve 60 and the distal end 32 of the barrel portion 18. The flowing and filling of the adhesive 80 enables the fit of the end cap 38 to the distal end 32 of the barrel portion 18 and the distal end 66 of the sleeve 60 to be specified with a larger or more forgiving manufacturing tolerance. The adhesive 80 also flows away from the end wall 72 in a proximal direction between the outer surface of the annular wall 76 and the inner surface 42 of the barrel portion 18. The adhesive 80 then rapidly cures and sets to fixedly attach the end cap 38 to the distal ends 66 and 32 of the sleeve 60 and the barrel portion 18, respectively. The dimension, h, illustrates the method of applying the adhesive 80 to the end cap 38 and the barrel portion 18. The adhesive 80 is initially applied within the sleeve 60 at the proximal side of the end cap 38, flows to the open spaces, helps to center the end cap 38 and begins to cure until it is set. The dimension, h, indicates that the viscosity of the adhesive 80 increased as it cured to the point where adhesive flow stopped before an equilibrium could be reached between the adhesive 80 within the sleeve 60 and the adhesive 80 located between the annular wall 76 and the barrel portion 18.

Figure 10:
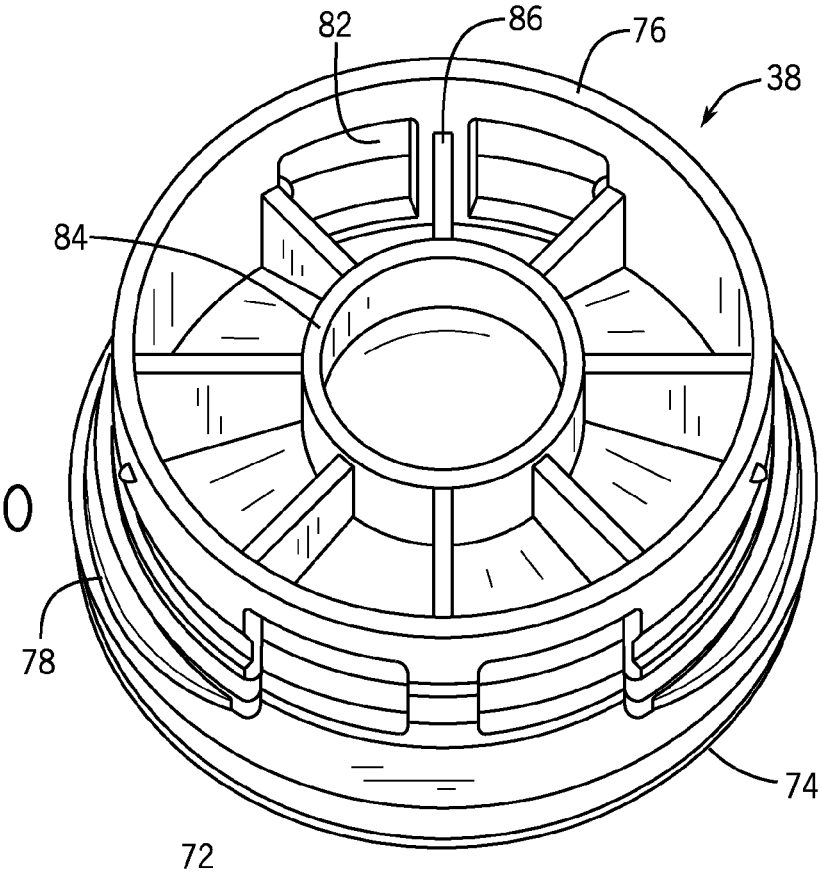
FIG. 10 is a side perspective view of the end cap of FIG. 8.
Figure 11:
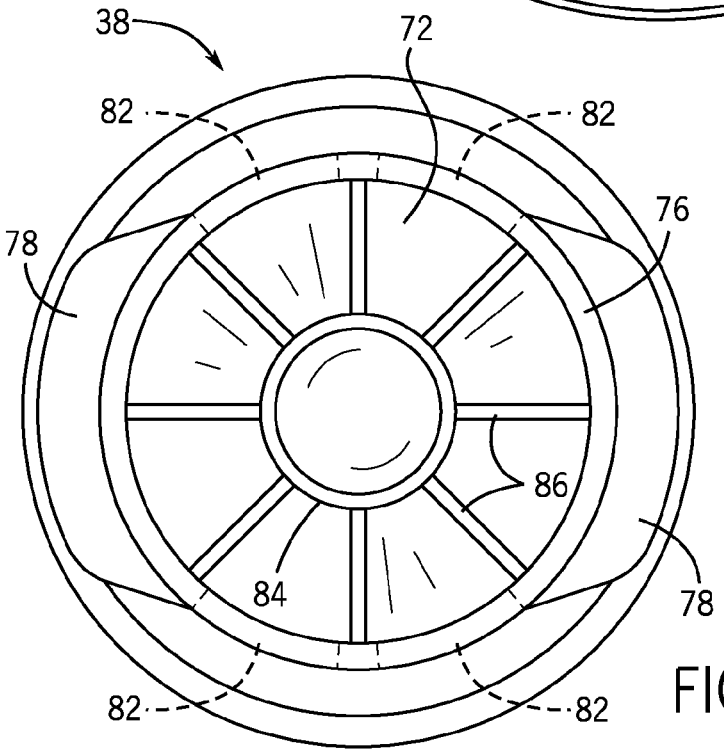
FIG. 11 is an end view of the end cap of FIG. 8 taken along the longitudinal axis from the perspective of the handle portion toward the end cap.
Figure 12:
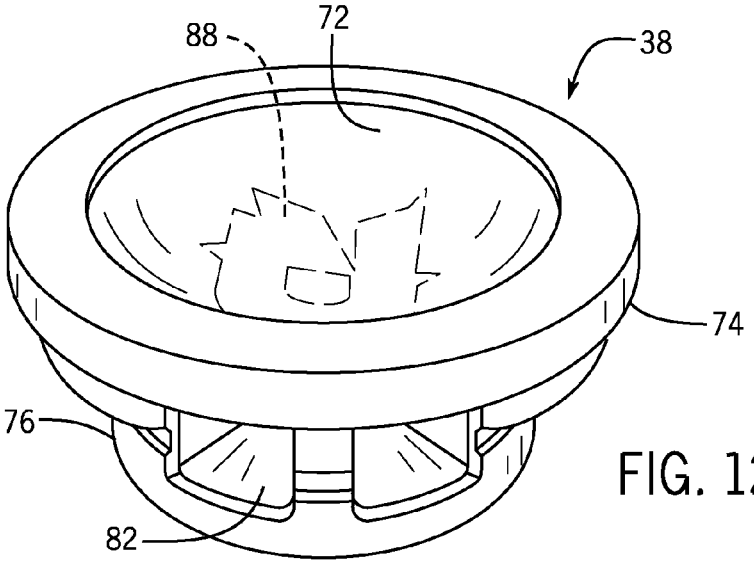
FIG. 12 is a side, opposite end perspective view of the end cap of FIG. 8.

Referring to FIGS. 10 through 12, the end cap 38 is illustrated apart from the bat 10. The end cap 38 further includes a support ring 84 inwardly extending from the end wall 72 and a plurality of ribs 86 radially projecting from the support ring 84 to the annular wall 76. The support ring 84 and ribs 86 provide additional structural support to the end cap 38. In alternative preferred embodiments, other structures, shapes, projections and/or ribs can be used to adjust the strength and structural integrity of the end cap. The end cap 38 is advantageously configured with the openings 82 and other grooves and recesses to facilitate the flow of the quick set adhesive 80.

Referring to FIG. 12, the end wall 72 of the end cap 38 can include graphical and/or alphanumeric indicia 88. The indicia 88 can be applied to an outer surface of the end wall 72. Similar to the indicia 42, the indicia 88 can be indicative of designs, trademarks, graphics, specifications, certifications, instructions, warnings and/or markings, and can be applied as a decal, as a screening or through other conventional means. The end wall 72 is preferably concave. In other preferred embodiments, the end wall 72 can be convex, planar, stepped, recessed, geodesic or formed in other shapes.

Referring to FIGS. 7 through 9, the configuration of the end cap 38 and the engagement of the proximal end 64 of the sleeve 60 to the distal end 24 of the handle portion 16 enables the sleeve 60 to be optimally positioned within and spaced apart from the inner surface 42 of the barrel portion 18. The size of the second separation 62 can be adjusted by adjusting the width of the annular wall 76 and the connection of the sleeve 60 to the handle portion 16. The positioning provided by these two connections enables the sleeve 60 to be suspended and centered within the barrel portion 18 over a substantial length of the barrel portion 18 as desired.

Figure 13:
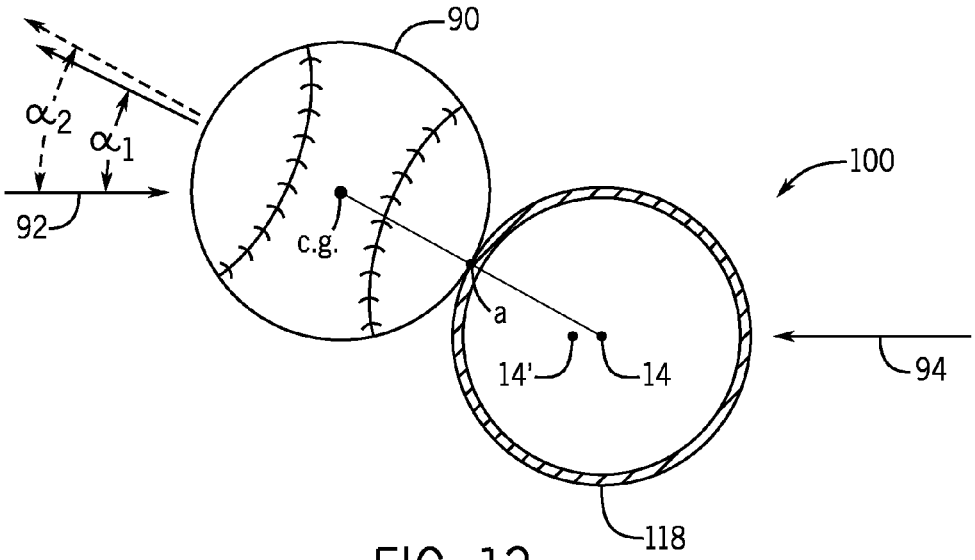
FIG. 13 is an image of a baseball impacting a barrel portion of a ball bat showing a transverse cross-sectional view of the barrel portion of the bat, and the launch angle of the ball from the bat.

FIG. 13 illustrates a ball 90 (such as a baseball or a softball) impacting a barrel portion 118 of a conventional single wall ball bat 100. The ball 90 is pitched and traveling in a horizontal path generally indicated by line 92. The ball bat 100 is being swung by a batter, and at the moment of impact, the barrel portion 118 is traveling in a path that includes arrow 94. As shown, the ball 90 is contacted by the barrel portion 118 beneath the center of gravity (e.g.) of the ball at point a. A first launch angle, $\alpha_1$, is defined by the line extending from the longitudinal axis 14 of the barrel portion 118 and the center of gravity of the ball 90 and horizontal line 92. The ball 90 launches, rebounds or travels away from the impact point a in the direction of the first launch angle $\alpha_1$.

Figure 14:
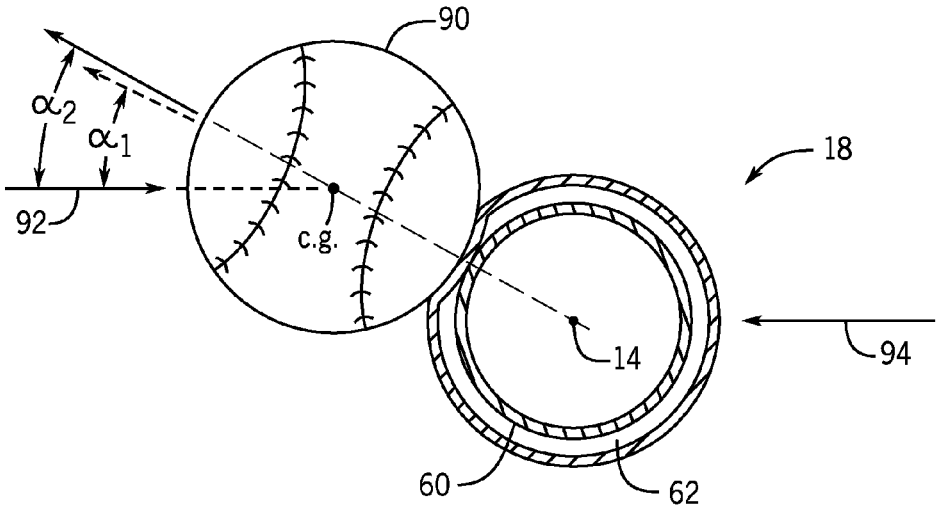
FIG. 14 is an image of a baseball impacting the barrel portion of the ball bat of FIG. 1 showing a transverse cross-sectional view of the barrel portion of the bat, and the launch angle of the ball from the bat.

Referring to FIG. 14, the ball 90 is shown impacting the barrel portion 18 of the bat 10 built in accordance with the present invention. The barrel portion 18 is shown as a single wall barrel. However, the barrel portion 18 can also be formed with an inner and outer wall 50 and 52 as described above. The barrel portion 18 is traveling in the same path as the bat of FIG. 13, and the pitched ball 90 is also traveling along the same path 92. Accordingly, the bat begins to contact the ball 90 at a position below the center of gravity of the ball 90 as in FIG. 13. The barrel portion 18 is configured to readily inwardly deflect upon impact with the ball 90. Upon impact the barrel portion 18 deflects inwardly and closes the second separation 62. The deflection continues until the barrel portion 18 contacts and operably engages the outer surface of the sleeve 60. The barrel portion 18 "bottoms out" or stops deflecting upon contact with the sleeve 60. The ball 90 then begins to rebound or project away from the barrel portion 18.

The impact described above and shown in FIG. 14 results in desirable characteristics not present or resulting from the impact involving the ball and a conventional bat, such as shown in FIG. 13. One desirable characteristic is that when the barrel portion 18 contacts the sleeve 60 vibrational and/or shock energy is transferred from the barrel portion 18 to the sleeve 60, and that energy travels proximally along the bat such that it can be felt by the batter. Many batters, particular skilled batters, prefer to use bats that provide feedback (in the form of vibrational energy or sensations) upon impact with the ball. The feedback enables the batter to learn from the impact. A ball impacted at the sweet spot of the bat, for example, will result in one form of sensation to the batter, and a ball hit away from the sweet spot can provide a much different sensation to the batter. The feedback is often referred to as the "feel" of the bat.

Some organized softball organizations, such as Amateur Softball Association of America ("ASA") headquartered in Oklahoma City, Okla., have specified the use of a softball having a lower compression value and a lower coefficient of restitution (COR) than previously used softballs. The compression value of the softballs decreased from approximately 375 psi to approximately 300 psi. Further, the COR of the softball also increased from approximately 0.44 to approximately 0.52. Many players have indicated that upon hitting the lower compression softballs with their existing bats, they receive little or no feel (or feedback) from the bat. Such players seek a bat that will provide feedback even upon impact with a lower compression ball. Provided that the speed of the ball to bat impact is sufficient (bat to ball impact speed is the sum speed of the bat and the speed of the ball along a line between the longitudinal axis of the bat and the c.g. of the ball), the bat 10, built in accordance with the present invention, provides such desired feedback to players through the contacting and engagement of the barrel portion 18 with the sleeve 60. The present invention enables the stiffness of the barrel portion to be configured to meet the desired player's need, the application of the bat, or the configuration of the ball. The barrel portion can be configured as a single, double or multiwall to vary its stiffness level. The size of the second separation can also be varied to allow for tuning or adjusting of the bat to match the appropriate player or application. Upon impact with the softball (even a lower compression softball) inward deflection of the barrel portion 18 occurs at the impact location and generally the deflection continues until the barrel portion engages the sleeve 60. The contact and engagement of the barrel portion 18 with the sleeve 60 generates sufficient vibrational feedback that is transmitted along the bat to the hands of the batter. Accordingly, bats built in accordance with the present invention, feedback to the batter regardless of the softness or compression of the game ball 90.

Another desirable characteristic that can be provided by a bat built in accordance with the present invention, is the sound produced by the bat 10 upon impact with the ball. The bat 10 provides a sound that varies from one impact location to another along the barrel portion 18 and can be used by batters as feedback. The sound produced by the bat during most impacts is satisfying and appropriate for the game. The sound in combination with the vibrational energy transfer of the bat provides the player with exceptional feedback.

Another desirable characteristic that can be provided by a bat built in accordance with the present invention, is an increase in the launch (or trajectory) angle of the ball rebounding from the bat following impact. Referring to FIGS. 13 and 14, the ball 90 impacting the barrel portion 18 results in a second launch angle, $\alpha_2$, that is greater than the first launch angle $\alpha_1$. The greater second launch angle $\alpha_2$ occurs because the ball 90 traveling in the direction of line 92 impacts the barrel portion 18, and remains in contact with the barrel portion 18 (traveling in a path that includes line 94) as the barrel portion deflects. The ball 90 then exits or rebounds from the barrel portion 18 when the barrel portion 18 deflects and operably engages the sleeve 60. The sleeve 60 has an outer diameter that is significantly smaller than the outer diameter of the barrel portion 18 prior to impact. At the point the ball exits or rebounds from the bat, the longitudinal axis 14 of the barrel portion 18 is closer to the center of gravity c. g. of the baseball than if the ball exited the barrel portion without significantly deflecting the outer wall. Therefore, a line extending through the longitudinal axis 14 and the center of gravity e.g. of the baseball with respect to horizontal defines the second launch angle $\alpha_2$. The second launch angle $\alpha_2$ is greater than the first launch angle $\alpha_1$. A ball hit with a greater or larger launch angle can travel a greater distance than a ball hit at a lower, smaller launch angle. In FIGS. 13 and 14, the ball 90 impacts the barrel portion of the bat such that the center of gravity of the ball is above the longitudinal axis. The magnitude of the difference in launch angle from a conventional single wall bat and the bat built in accordance with the present invention will vary depending upon the direction of the pitched ball, the path of travel of the barrel portion and relative location of the center gravity of the ball with respect to the longitudinal axis of the barrel portion.

Figure 15:
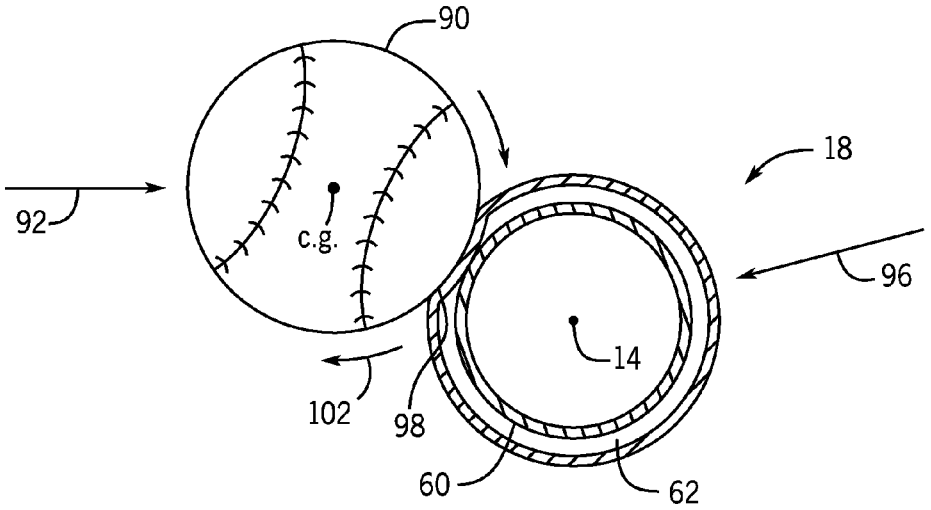
FIG. 15 is an image of a baseball impacting the barrel portion of the ball bat of FIG. 1 showing the effect of transverse cross-sectional view of the barrel portion of the bat.

Another desirable characteristic that can be provided by a bat built in accordance with the present invention is that the bat can enable a batter to impart more spin to the ball during impact than with a conventional single wall bat. Referring to FIG. 15, the ball 90 traveling in the direction of the line 92 and impacting the barrel portion 18 that is being swung in a path that includes the line 96, for example, results in greater contact surface area 98 between with the pitched ball 90 and the barrel portion 18. The greater contact area 98 allows for more spin (represented by arrow 102) to be imparted to the baseball. The greater contact area 98 results from the significant deflection of the barrel portion 18 of the bat upon impact and the continued deflection to the operable engagement with the sleeve 60. The greater contact area 98 provides more frictional interaction and enables the bat to impart a greater spin 102 than a comparable ball impact with a conventional single wall bat. The bat 10 built in accordance with the present invention can also result in more spin being imparted to the ball 90 because the dwell time (or time the ball 90 is in contact with the barrel portion 18) is greater than the dwell time of a ball impacting a conventional single wall bat. The configuration of the barrel portion 18 to allow for significant deflection upon impact with a ball to the sleeve 60 provides the ability to increase the contact surface area 98 and the dwell time.

The ability to impart spin onto a batted ball can result in significant performance improvements. For example, one analysis found that a batted ball hit at a launch angle of 25 degrees and having a spin (or spin rate) of 0 RPM had a distance traveled of approximately 310 feet in the air. A second ball hit at a launch angle of 25 degrees and having a spin of 1000 RPMs has a distance traveled of approximately 360 feet, and a third ball hit at a launch angle of 25 degrees and having a spin of 2000 RPMs has a distance traveled of approximately 390 feet. Accordingly, analysis of spin on a batted ball indicates that the higher the spin of the batted ball, the longer the potential distance of traveled by the batted ball. An estimate of the extra distance traveled based upon RPM is approximately 4 feet per 100 RPM of spin. Therefore, a batter can make a ball travel farther simply by imparting more spin to the ball.

Table 1 provides a summary of ball trajectories from a play test are shown on a ball field. A Trackman® Ball Tracking System by Trackman A/S of Vedbaek, Denmark was used to measure and track the trajectory of softballs hit by a professional bat tester. Two separate slowpitch softball bats were each hit 15 times for a total of 30 hits. The first bat is the DeMarini® The One™-13 bat which includes a barrel portion formed of a fiber composite material. The One™-13 bat has a length of 34 inches and a weight of 27 ounces. The second bat is a DeMarini® FLS™ bat made in accordance with the present invention, such as the embodiment of FIGS. 7 and 8. The DeMarini® FLS™ bat had a length of 34 inches and a weight of 27 ounces. The softballs used were 0.52 COR, 300 psi compression DeMarini® Stone™ ball. Each bat was used to hit 15 separate slow pitched softballs and the distance, revolutions per minute (RPM) trajectory angle and speed were measured for each hit.

TABLE 1

| | DeMarini ® FLS ™ | DeMarini ® The ONE ™-12 |
|---|---|---|
| Average Distance (feet) | 317 | 301 |
| Max. Distance (feet) | 350 | 323 |
| Average RPM | 1537 | 829 |
| Avg. Trajectory Angle | 21.7 | 18.5 |
| Average Exit Speed | 83.4 | 84.1 |
| Maximum Exit Speed | 90.1 | 93.1 |

The test results of the two slowpitch bat models indicates that a bat built in accordance with the present invention, such as the DeMarini® FLS™ ball bat can produce greater travel distance, and impart more spin on the ball than a similar existing bat the DeMarini® The ONE-13. Importantly, the bat of the present invention enables a batter to achieve increased flight distance through an increased launch angle and by imparting spin without increasing the exit speed. Exit speed is often tied to bat performance limitations. Therefore, bats built in accordance with the present invention can enable a player to achieve greater distance traveled, more spin and a higher launch angle without exceeding the bat standards and/or requirements of baseball and/or softball organizations.

The bat 10 of the present invention is configured for competitive, organized baseball or softball. For example, embodiments of ball bats built in accordance with the present invention can fully meet the bat standards and/or requirements of one or more of the following baseball and softball organizations: ASA Bat Testing and Certification Program Requirements; United States Specialty Sports Association ("USSSA") Bat Performance Standards for baseball and softball; International Softball Federation ("ISF") Bat Certification Standards; National Softball Association ("NSA") Bat Standards; Independent Softball Association ("ISA") Bat Requirements; Ball Exit Speed Ratio ("BESR") Certification Requirements of the National Federation of State High School Associations ("NFHS"); Little League Baseball Bat Equipment Evaluation Requirements; PONY Baseball/Softball Bat Requirements; Babe Ruth League Baseball Bat Requirements; American Amateur Baseball Congress ("AABC") Baseball Bat Requirements; and, especially, the NCAA BBCOR Standard or Protocol.

Accordingly, the term "bat configured for organized, competitive play" refers to a bat that fully meets the ball bat standards and/or requirements of, and is fully functional for play in, one or more of the above listed organizations.

While the preferred embodiments of the invention have been illustrated and described, it will be appreciated that various changes can be made therein without departing from the spirit and scope of the invention. For example, one of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A ball bat extending along a longitudinal axis configured for hitting a ball, the bat comprising:

a handle portion;

a barrel portion coupled to the handle portion, the barrel portion including a proximal end region, a distal end region, and a central region between the proximal and distal end regions;

a tubular sleeve positioned within the barrel portion, and including a proximal end region and a distal end region, the distal end region of the tubular sleeve having a substantially constant outer diameter and having an end surface, the proximal end region of the tubular sleeve coupled to the handle portion; and an end cap coupled to the distal end region of the sleeve and to the distal end region of the barrel portion at least in part by an adhesive, the end cap including an end wall having an inner surface and an outer surface, an annular wall proximally extending from the inner surface of the end wall toward the handle portion, and a ridge outwardly extending from the annular wall, the annular wall and the ridge of the end cap configured to engage an inner surface and end surface of the distal end region of the sleeve, respectively, the annular wall defining at least one through-wall opening configured for facilitating flow of the adhesive through and about the annular wall during the coupling of the end cap to the barrel portion, the at least one through-wall opening defined by at least one continuous edge in the annular wall forming a closed shape.

2. The ball bat of claim 1, wherein the end cap further includes an outer lip configured to engage the distal end region of the barrel portion.

3. The ball bat of claim 1, wherein the end cap includes at least two through-wall openings and at least one groove for facilitating the flow of adhesive through and about the annular wall.

4. The ball bat of claim 1, wherein is shaped to assist in centering and spacing apart the distal end region of the sleeve from the distal end region of the barrel portion.

5. The ball bat of claim 4, wherein the barrel portion and the sleeve are spaced apart by a separation.

6. The ball bat of claim 5, wherein the separation is within the nominal range of 0.030 to 0.125 inch when measured radially from the longitudinal axis.

7. The ball bat of claim 1, wherein the barrel portion includes an inner wall and an outer wall, and the inner and outer walls define a first separation and are configured to allow for independent movement between the inner wall and the outer wall upon impact with the ball.

8. The ball bat of claim 7, wherein the barrel portion and the sleeve are spaced apart to define a second separation, and wherein the second separation is within the nominal range of 0.030 to 0.125 inch when measured radially from the longitudinal axis.

9. The ball bat of claim 8, wherein the ratio of the second separation to the first separation is at least 10.

10. The ball bat of claim 1, wherein the outer surface of the end wall includes graphical and/or alphanumeric indicia.

11. A method of applying an improved end cap to a multi-wall ball bat having a longitudinal axis, the method including the steps of:

obtaining the end cap including an end wall having an inner surface, an outer surface and forming an outer lip, and an annular wall proximally extending from the inner surface of the end cap toward the handle portion, and a ridge outwardly extending from the annular wall, the annular wall including at least one continuous edge defining at least one closed shape and at least one through-wall opening;

obtaining a longitudinally extending tubular sleeve having a distal end region of substantially constant diameter and including an end surface;

positioning the distal end region of the tubular sleeve over at least a portion of the annular wall such that the end surface engages the ridge;

positioning the barrel portion over the tubular sleeve and over at least a portion of the annular wall until the distal end region of the barrel portion engages the outer lip of the end wall of the end cap;

applying an initially flowable and curable adhesive into the end cap through the inner diameter of the tubular sleeve, the adhesive filling the inner surfaces of the distal end region of the sleeve, and flowing through the at least one opening in the annular wall to extend between the distal end region of the sleeve and the distal end region of the barrel portion; and allowing the adhesive to cure.

12. The method of claim 11, wherein the annular wall includes a ridge, and wherein the distal end region engages the ridge.

13. The method of claim 11, wherein the end cap the end cap is shaped to facilitate the centering and spacing apart the distal end region of the sleeve from the distal end region of the barrel portion.

14. The method of claim 13, wherein the barrel portion and the sleeve are spaced apart by a separation between the barrel portion and the sleeve.

15. The method of claim 14, wherein the separation is within the nominal range of 0.030 to 0.125 inch when measured radially from the longitudinal axis.

16. The method of claim 11, wherein the adhesive is a fast curing epoxy.

17. The method of claim 11, wherein the adhesive is a fast curing adhesive that extends between the barrel portion and the sleeve by a first dimension measured with respect to the longitudinal axis from the end wall before fully curing.

18. The method of claim 17, wherein the adhesive reaches a second dimension within the sleeve and the annular wall measured with respect to the longitudinal axis before fully curing, and wherein the second dimension is greater than the first dimension.

* * * * *